US008662360B2

(12) United States Patent
Yuan

(10) Patent No.: US 8,662,360 B2
(45) Date of Patent: Mar. 4, 2014

(54) LIQUID DISTRIBUTOR AND CONTAINER PROVIDED WITH THE LIQUID DISTRIBUTOR

(75) Inventor: Jianjun Yuan, Zhejiang (CN)

(73) Assignee: Yuyao Tirrit Co., Ltd., Zhejiang (CN)

( * ) Notice: Subject to any disclaimer, the term of this patent is extended or adjusted under 35 U.S.C. 154(b) by 55 days.

(21) Appl. No.: 13/382,047

(22) PCT Filed: Aug. 18, 2011

(86) PCT No.: PCT/CN2011/078577
§ 371 (c)(1),
(2), (4) Date: Jan. 3, 2012

(87) PCT Pub. No.: WO2012/062146
PCT Pub. Date: May 18, 2012

(65) Prior Publication Data

US 2012/0187157 A1 Jul. 26, 2012

(30) Foreign Application Priority Data

Nov. 12, 2010 (CN) ..... 2010 1 0551560
Nov. 12, 2010 (CN) ..... 2010 2 0615790 U

(51) Int. Cl.
*B65D 5/72* (2006.01)

(52) U.S. Cl.
USPC ..... 222/496; 222/491; 222/492; 222/493; 222/495; 222/525

(58) Field of Classification Search
USPC ..... 222/491–497, 511, 513, 518, 519, 522, 222/523, 525, 212, 520, 521, 254.9, 476, 222/507, 514, 566, 422, 421, 420
See application file for complete search history.

(56) References Cited

U.S. PATENT DOCUMENTS 2,060,622 A * 11/1936 Jones ..... 222/521
3,887,116 A * 6/1975 Ishikawa et al. ..... 222/520

(Continued)

FOREIGN PATENT DOCUMENTS

CN 1756702 A 4/2006
CN 102070115 A 5/2011

(Continued)

OTHER PUBLICATIONS

International Search Report for International Application No. PCT/CN2011/078577 dated Nov. 17, 2011.

*Primary Examiner* — Kevin P Shaver
*Assistant Examiner* — Michael J Melaragno
(74) *Attorney, Agent, or Firm* — Kratz, Quintos & Hanson, LLP

(57) ABSTRACT

In a liquid distributor, a valve seat is hollow axially with a connection part in the lower end. The valve bonnet can axially move relative to the valve seat, and has a liquid outlet and a cylinder housing part. The valve plug is in a fluid outlet chamber, comprising a valve plug main body, a plug and valve plate part. The valve plug main body is hollow axially and the bottom with the inner wall of the central passage seals. The plug is molded in the head of the aforementioned valve plug main body and a transversal outlet is formed between the plug and the valve plug main body. The valve plate part radially extends and is molded in the upper end of the valve plug main body; the elastic piece is arranged in the fluid outlet chamber. The invention further discloses a container provided with the liquid distributor.

8 Claims, 3 Drawing Sheets

(56) References Cited

U.S. PATENT DOCUMENTS

| | | | | |
|---|---|---|---|---|
| 5,310,097 | A * | 5/1994 | Leuenberger | 222/521 |
| 6,244,476 | B1 * | 6/2001 | Moretti | 222/521 |
| 6,938,794 | B2 | 9/2005 | Elder | |
| 7,731,067 | B2 * | 6/2010 | Schliemann | 222/496 |
| 2005/0077323 | A1 | 4/2005 | Alei | |
| 2009/0236445 | A1 * | 9/2009 | Lintern et al. | 239/483 |

FOREIGN PATENT DOCUMENTS

| | | |
|---|---|---|
| CN | 201890758 U | 7/2011 |
| JP | 64-45266 | 2/1989 |
| WO | WO 98/55368 A2 | 12/1998 |

* cited by examiner

LIQUID DISTRIBUTOR AND CONTAINER PROVIDED WITH THE LIQUID DISTRIBUTOR

TECHNICAL FIELD OF THE INVENTION

The invention relates to a liquid distributor, and in particular to a liquid distributor applied to personal care products and cosmetics. The invention further relates to a container provided with the liquid distributor. The container can be used in the technical field of packaging bottles of personal care products, cosmetic bottles, medicine bottles, etc.

BACKGROUND OF THE INVENTION

The existing packing containers for cosmetics and personal care products generally comprise the container itself and the liquid distributor arranged at the liquid outlet of the container. The common liquid distributors comprise a liquid outlet assembly fixedly connected with the container main body and a head cap arranged in the upper end of the liquid outlet assembly. Due to the air pump principle, as long as users press the head cap downwardly, liquid will flow out from the container main body through the outlet of the liquid outlet assembly, and the outlet is often arranged in the head cap. In this case, users can receive liquid flowing from the outlet with one hand, and press the head cap downwardly with the other hand so as to extract appropriate liquid contained in the container.

The current known liquid distributor has the following disadvantages that: first, it needs both hands for cooperation during operation, which is inconvenient; second, it has bad sealing performance, and liquid in the container goes bad or loses water easily due to the air effect when communicating with the outside, thereby influencing the product efficiency; third, it causes a waste, and there is liquid residue in the output pipeline corresponding to the outlet of the liquid outlet assembly, which will flow out from the outlet if the products are not placed properly or are shaken; for some liquid with special requirements, for example some disposable liquid (such as preparation for medical purposes) that will be influenced adversely after contacting air, such as going bad, the liquid left within the liquid distributor will influence the quality of liquid directly so as to further pollute the liquid within the whole container; and finally, due to the limitation of the volume within the container, liquid that flows out after each press varies and cannot be accurately controlled more or less, and a part of the liquid is wasted.

In order to resolve the above technical problem, many technical solutions are disclosed in the prior art, such as Chinese invention patent Liquid Distributor (Authorized Publication Number: CN1181929C) with the patent number being ZL01815215.5. In the patent, the distributing head is pressed so as to cause the volume to change within the bellow, thus liquid flowing out. The design is clever, but the requirements for processing and shaping components are relatively strict, and the cost invested for the device is relatively high; we can also refer to Chinese utility model patent Novel Liquid Distributor (Authorized Publication Number: CN2937092Y) with the patent number being ZL200620106314.0, which comprises a cover body and a main body. The main body is provided with a liquid outlet device and a button which can control the action of the liquid outlet device. Moreover, a one-way valve is arranged within the liquid outlet device, and it is more compact in structure. Meanwhile, liquid within the container does not contact air in the storage process so as to prevent the liquid from going bad. For the similar patent, we can also refer to Chinese utility model patent Novel Liquid Distributor (Authorized Publication Number: CN201052965Y) with the patent number being ZL200720109227.5.

SUMMARY OF THE INVENTION

The technical problem to be solved by the invention is to further provide a liquid distributor which is compact in structure, simple in operation and good in sealing performance, aiming at the above state of the art.

Another technical problem to be solved by the invention is to further provide a liquid distributor, in which liquid within the container is isolated from air in the storage state.

A further technical problem to be solved by the invention is to provide a liquid distributor which can accurately control the liquid outlet amount.

A further technical problem to be solved by the invention is to further provide a container which is compact in structure, simple in operation and good in sealing performance.

Another technical problem to be solved by the invention is to further provide a container, in which liquid within the container is isolated from air in the storage state.

A further technical problem to be solved by the invention is to provide a container which can accurately control the liquid outlet amount.

To solve the technical problem above, the invention uses the following technical solution: a liquid distributor, wherein it comprises a valve seat, which is hollow axially so as to form a central passage and is provided with a connection part in the lower end thereof, wherein the connection part is suitable for being connected with the port of the container main body;

a valve bonnet, which is arranged in the upper end of the aforementioned valve seat and can axially move relative to the valve seat from the first position to the second position, wherein the valve bonnet is provided with a liquid outlet and a cylinder housing part which can be assembled with the upper end of the aforementioned valve seat to form a fluid outlet chamber, wherein the cylinder housing part is annularly molded in the inner wall of the valve bonnet in a convex way, and both ends of the aforementioned fluid outlet chamber are communicated with the central passage and the liquid outlet, respectively;

a valve plug, which is arranged in the aforementioned fluid outlet chamber, comprising a valve plug main body, a plug and valve plate part, wherein said valve plug main body is hollow axially so as to form a central flow passage communicated with the central passage, and the bottom of the valve plug main body is in sealed contact with the inner wall of the central passage, said plug is molded in the head of the valve plug main body and a transversal outlet which is communicated with the central flow passage is formed between the plug and the valve plug main body, said valve plate part radially extends and is molded in the upper end of said valve plug main body, and the edge of the valve plate part is in sealed contact with the inner wall of said cylinder housing part and can house liquid flowing from the transversal outlet; and an elastic piece, which is arranged in the aforementioned fluid outlet chamber and provides said valve plug with an axially outward force so that the valve plug can always maintain the trend of moving outwardly, wherein, when being in the first position, the plug of said valve plug mates with the liquid outlet in a sealing way and the bottom of the valve plug is limited in the valve seat so that it cannot axially move.

The inner wall of said valve bonnet is molded with a convex ring in a convex way. The convex ring is located in the periphery of said cylinder housing part and is provided with internal threads or positioning ribs in the inner wall thereof. Correspondingly, said valve seat is provided with a connecting ring, the outer wall of which is provided with external threads adapted for said internal threads or positioning ribs or at least two positioning grooves which are radially arranged.

Furthermore, the sealing performance is enhanced. Said elastic piece is a compression spring, one end of which abuts against the lower end surface of said valve plate part, while the other end of which abuts against the spring seat of said valve seat. The spring seat is hollow and is molded in the inner wall thereof with a step surface limiting the valve plug main body to move downwardly.

Said spring seat protrudes from the valve seat to form a ring, while said connecting ring is located in the periphery of the ring. Said cylinder housing part is adapted between the connecting ring and the ring, and the bottom end of said compression spring abuts against the aforementioned ring.

In order to accurately control the flow and ensure that there is no liquid left in the liquid outlet after liquid is taken, the diameter of the liquid outlet of said valve bonnet decreases from the outside to the inside successively, and correspondingly, the diameter of said plug increases from the outside to the inside successively.

A container comprises a container main body and a liquid distributor, the liquid distributor being able to be arranged at the port of the aforementioned container main body detachably, wherein said liquid distributor comprises a valve seat, which is hollow axially so as to form a central passage and is provided in the lower end thereof with a connection part which is connected with the port of the aforementioned container main body;

a valve bonnet, which is arranged in the upper end of the aforementioned valve seat and can axially move from the first position to the second position relative to the valve seat, wherein the valve bonnet is provided with a liquid outlet and a cylinder housing part which can be assembled with the upper end of the aforementioned valve seat to form a fluid outlet chamber, wherein the cylinder housing part is annularly molded in the inner wall of the valve bonnet in a convex way, and both ends of the aforementioned fluid outlet chamber are communicated with the central passage and the liquid outlet, respectively;

a valve plug, which is arranged in the aforementioned fluid outlet chamber, comprising a valve plug main body, a plug and valve plate part, wherein said valve plug main body is hollow axially so as to form a central flow passage communicated with the central passage, and the bottom of the valve plug main body is in sealed contact with the inner wall of the central passage, the aforementioned plug is molded in the head of the aforementioned valve plug main body and a transversal outlet which is communicated with the central flow passage is formed between the plug and the valve plug main body, the aforementioned valve plate part radially extends and is molded in the upper end of the aforementioned valve plug main body, and the edge of the valve plate part is in sealed contact with the inner wall of the aforementioned cylinder housing part and can house liquid flowing from the transversal outlet; and an elastic piece, which is arranged in the aforementioned fluid outlet chamber and provides the aforementioned valve plug with an axially outward force so that the valve plug can always maintain the trend of moving outwardly, wherein, when being in the first position, the plug of the aforementioned valve plug mates with the liquid outlet in a sealing way and the bottom of the valve plug is limited in the valve seat so that it cannot axially move.

Compared with the prior art, the invention has the following advantages that: it can be opened only by enabling the valve bonnet to perform the axial relative movement relative to the valve seat and then squeezing the container bottle, which is convenient and can be operated by one hand; the plug will block the liquid outlet in the storage process with better sealing performance, and liquid within the container is isolated from the external world, which makes the liquid not go bad or lose water easily due to the air effect or influence the product efficiency; there is no waste because there is no liquid left in the liquid outlet after being used; the liquid extracting amount can be adjusted by squeezing the container so that the extraction amount is more accurate and there is no waste; and the elastic piece will seal the container instantly so as to being isolated from the outside air; it is simple in overall structure, convenient and fast in assembly, and easy to manufacture in a large scale.

DETAILED DESCRIPTION OF THE INVENTION

Figure 1:
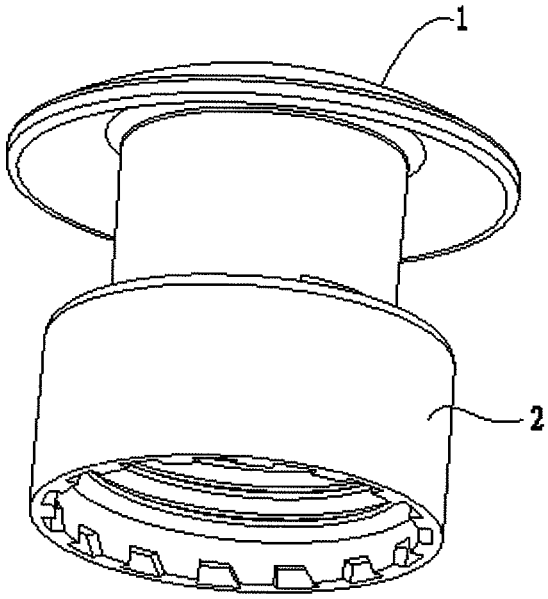
FIG. 1 shows a schematic diagram of the solid structure of embodiment one.
Figure 2:
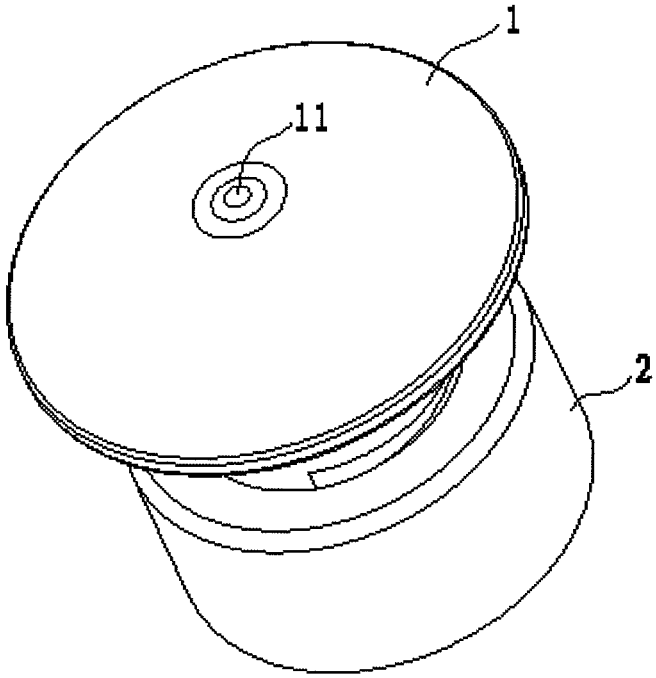
FIG. 2 shows a schematic diagram of the solid structure of embodiment one from another angle of view.
Figure 3:
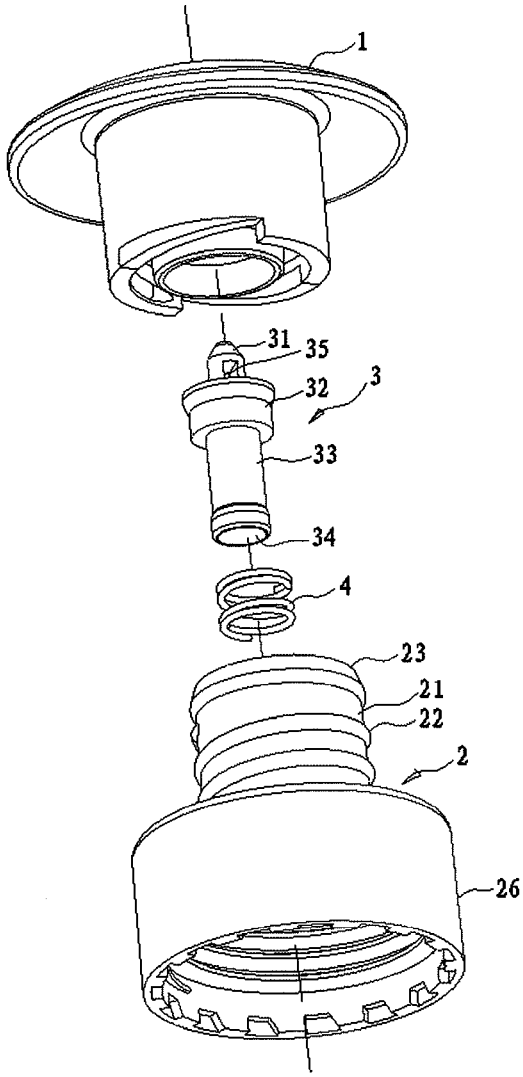
FIG. 3 shows an exploded assembly diagram.

The invention will be described in detail in combination with the embodiments of the accompanying drawings.

In embodiment one, as shown in FIG. 1, FIG. 2, FIG. 3 and FIG. 5, the liquid distributor in the embodiment comprises a valve seat 2, a valve bonnet 1, a valve plug 3, and an elastic piece 4.

The valve seat 2 is hollow axially so as to form a central passage 27 and is provided with a connection part 26 in the lower end thereof, wherein the connection part 26 is suitable for being connected with the port of the container main body; the valve bonnet 1 is arranged in the upper end of the valve seat 2 and can axially move from the first position to the second position relative to the valve seat 2, the valve bonnet is provided with a liquid outlet 11 and a cylinder housing part 13 which can be assembled with the upper end of the valve seat 2 to form a fluid outlet chamber. The cylinder housing part 13 is annularly molded in the inner wall of the valve bonnet 1 in a convex way, and both ends of the fluid outlet chamber are communicated with the central passage 27 and the liquid outlet 11, respectively.

Figure 4:
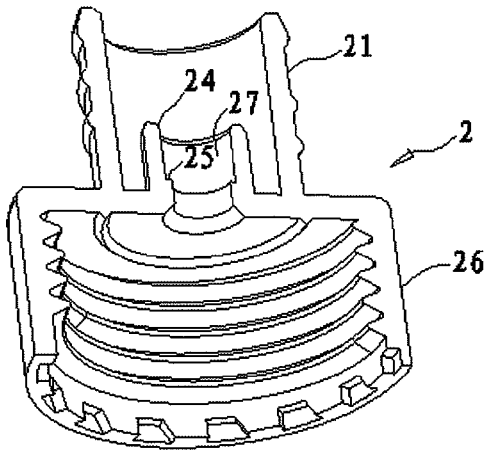
FIG. 4 shows a solid cross-section view of the valve seat in FIG. 3.
Figure 5:
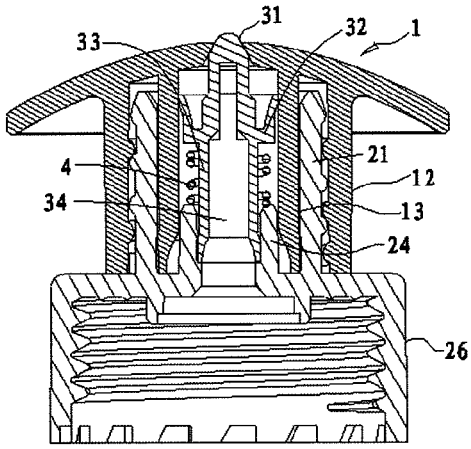
FIG. 5 shows a cross-section view of embodiment one.

In combination with FIG. 4, the assembly relationship between the valve bonnet and the valve seat in the embodiment is as follows: the inner wall of the valve bonnet is molded with a convex ring in a convex way, the convex ring is located in the periphery of said cylinder housing part and is provided with internal threads in the inner wall thereof, and correspondingly, the valve seat is provided with a connecting ring, the outer wall of which is provided with external threads adapted for the internal threads or positioning ribs. Furthermore, limiting ribs 23 are molded on the connecting ring above the external threads.

The valve plug 3 is arranged in the fluid outlet chamber, comprising a valve plug main body 33, a plug 31 and valve plate part 32, wherein the valve plug main body 33 is hollow axially so as to form a central flow passage 34 communicated with the central passage 27, and the bottom of the valve plug main body 33 is in sealed contact with the inner wall of the central passage 27. The plug 31 is molded in the head of the valve plug main body 33 and a transversal outlet 35 which is communicated with the central flow passage 34 is formed between the plug and the valve plug main body 33. The valve plate part 32 radially extends and is molded in the upper end of the valve plug main body 33, and the edge of the valve plate part is in sealed contact with the inner wall of the cylinder housing part 13 and can house liquid flowing from the transversal outlet 35.

The elastic piece 4 is arranged in the fluid outlet chamber and provides the valve plug 3 with an axially outward force so that the valve plug 3 can always maintain the trend of moving outwardly. A compression spring is used in the embodiment. One end of the compression spring abuts against the lower end surface of the valve plate part 32, while the other end of the compression spring abuts against the spring seat of the valve seat. The spring seat is hollow and is molded in the inner wall thereof with a step surface 25 limiting the valve plug main body to move downwardly. The spring seat protrudes from the valve seat 2 to form a ring 24, and the connecting ring 21 is located in the periphery of the ring 24. The cylinder housing part 13 is adapted between the connecting ring 21 and the ring 24, and the bottom end of the compression spring abuts against the ring 24.

Furthermore, the diameter of the liquid outlet 11 of the valve bonnet increases from the outside to the inside successively, and correspondingly, the diameter of the plug 31 increases from the outside to the inside successively.

Figure 6:
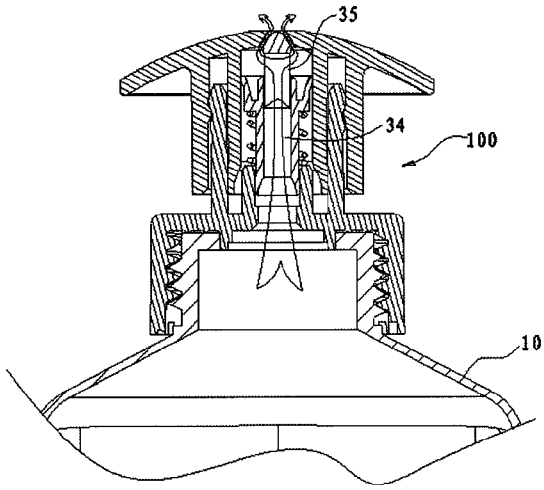
FIG. 6 shows a reference diagram of the using status of embodiment one.

As shown in FIG. 6, when the liquid distributor 100 is used, the connecting part 26 of the valve seat is fixedly connected with the container 10. In the embodiments, a threaded connection manner is adopted. When being in the first position, the plug 31 of the valve plug mates with the liquid outlet 11 in a sealing way and the bottom of the valve plug main body 33 is limited in the valve seat 2 so that it cannot axially move; when liquid is required, as shown in FIG. 6, the valve bonnet 1 is rotated first so that the valve bonnet 1 axially moves upwardly relative to the valve seat, namely being located in the second position. At this time, the valve plug 3 bounces naturally and upwardly under the effect of the elastic piece 4, and still blocks the liquid outlet 11. And then the container 10 is squeezed. Liquid in the container 10 flows from the central passage 27 to the central flow passage 34 of the valve plug main body, and flows from the transversal outlet 35 to the upped end surface of the valve plate part 32. Due to the liquid effect, the valve plate part 32 overcomes the elasticity of the elastic piece 4 and moves downwardly. Meanwhile, the plug 31 removes from the liquid outlet 11. Liquid flows out from the upper end surface of the valve plate part 32 via the liquid outlet 11. After liquid is taken, the container 10 is loosened, and the valve bonnet 1 is screwed at the same time so that the liquid distributor 100 is closed.

Figure 7:
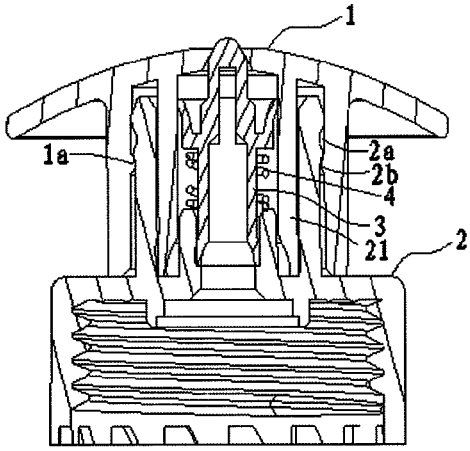
FIG. 7 shows a cross-section view of embodiment two.

In embodiment two, as shown in FIG. 7, the assembly relationship between the valve bonnet and the valve seat in the embodiment is as follows: the inner wall of the valve bonnet 1 is molded with a convex ring 12 in a convex way, the convex ring 12 is located in the periphery of the cylinder housing part 13 and is provided with a positioning rib 1*a* in the inner wall thereof, and correspondingly, the valve seat 2 is provided with a connecting ring 21, the outer wall of which is provided with the ridially arranged positioning groove 2*a* and positioning groove 2*b* adapted for the positioning rib 1*a*. The other structures are the same as the embodiment one.

The invention claimed is:

1. A liquid distributor, suitable for being connected with a port of a container main body, the liquid distributor comprising:

a valve seat, which is hollow axially so as to include a central passage and includes a connection part in the lower end thereof, wherein the connection part is suitable for being connected with the port of the container main body;

a valve bonnet, which is arranged in and coupled to the upper end of the valve seat such that the valve bonnet can axially move from a first position to a second position relative to the valve seat, wherein the valve bonnet includes a liquid outlet and a cylinder housing part which can be assembled with the upper end of the valve seat to form a fluid outlet chamber, the cylinder housing part is annularly molded in the inner wall of the valve bonnet in a convex way, and both ends of the fluid outlet chamber are communicated with the central passage and the liquid outlet, respectively;

a valve plug, which is disposed in the fluid outlet chamber, comprising a valve plug main body, a plug, and valve plate part, wherein said valve plug main body is hollow axially so as to form a central flow passage communicated with the central passage, and the bottom of the valve plug main body is in sealed contact with the inner wall of the central passage, said plug is molded in the head of the valve plug main body, and a transversal outlet which is communicated with the central flow passage is formed between the plug and the valve plug main body, the valve plate part radially extends and is molded in the upper end of said valve plug main body, and the edge of the valve plate part is in sealed contact with the inner wall of the cylinder housing part such that it can house liquid flowing from the transversal outlet; and an elastic piece, which is arranged in the fluid outlet chamber and provides the valve plug with an axially outward force such that the valve plug can always maintain the trend of moving outwardly, wherein, when being in the first position, the plug of the valve plug mates with the liquid outlet in a sealing way and the bottom of the valve plug is limited in the valve seat so that it cannot axially move, and wherein the inner wall of said valve bonnet is molded with a convex ring in a convex way, the convex ring is located in the periphery of said cylinder housing part and is provided with internal threads in the inner wall thereof, and correspondingly, said valve seat is provided with a connecting ring, the outer wall of which is provided with external threads adapted for said internal threads.

2. The liquid distributor according to claim 1, wherein the diameter of the liquid outlet of said valve bonnet increases from the outside to the inside successively, and correspondingly, the diameter of said plug increases from the outside to the inside successively.

3. A container, comprising the container main body and the liquid distributor according to claim 1, the liquid distributor being able to be arranged at the port of the container main body detachably.

4. The liquid distributor according to claim 1, wherein said elastic piece is a compression spring, one end of which abuts against the lower end surface of said valve plate part, while the other end of which abuts against the spring seat of said valve seat, and the spring seat is hollow and is molded in the inner wall thereof with a step surface limiting the valve plug main body to move downwardly.

5. The liquid distributor according to claim 4, wherein said spring seat protrudes from the valve seat to form a ring, said connecting ring is located in the periphery of the ring, said cylinder housing part is adapted between the connecting ring and the ring, and the bottom end of said compression spring abuts against the ring.

6. The liquid distributor according to claim 4, wherein the diameter of the liquid outlet of said valve bonnet increases from the outside to the inside successively, and correspondingly, the diameter of said plug increases from the outside to the inside successively.

7. The liquid distributor according to claim 5, wherein the diameter of the liquid outlet of said valve bonnet increases from the outside to the inside successively, and correspondingly, the diameter of said plug increases from the outside to the inside successively.

8. A liquid distributor, suitable for being connected with a port of a container main body, the liquid distributor comprising:

a valve seat, which is hollow axially so as to include a central passage and includes a connection part in the lower end thereof, wherein the connection part is suitable for being connected with the port of the container main body;

a valve bonnet, which is arranged in and coupled to the upper end of the valve seat such that the valve bonnet can axially move from a first position to a second position relative to the valve seat, wherein the valve bonnet includes a liquid outlet and a cylinder housing part which can be assembled with the upper end of the valve seat to form a fluid outlet chamber, the cylinder housing part is annularly molded in the inner wall of the valve bonnet in a convex way, and both ends of the fluid outlet chamber are communicated with the central passage and the liquid outlet, respectively;

a valve plug, which is disposed in the fluid outlet chamber, comprising a valve plug main body, a plug, and valve plate part, wherein said valve plug main body is hollow axially so as to form a central flow passage communicated with the central passage, and the bottom of the valve plug main body is in sealed contact with the inner wall of the central passage, said plug is molded in the head of the valve plug main body, and a transversal outlet which is communicated with the central flow passage is formed between the plug and the valve plug main body, the valve plate part radially extends and is molded in the upper end of said valve plug main body, and the edge of the valve plate part is in sealed contact with the inner wall of the cylinder housing part such that it can house liquid flowing from the transversal outlet; and an elastic piece, which is arranged in the fluid outlet chamber and provides the valve plug with an axially outward force such that the valve plug can always maintain the trend of moving outwardly, wherein, when being in the first position, the plug of the valve plug mates with the liquid outlet in a sealing way and the bottom of the valve plug is limited in the valve seat so that it cannot axially move, and wherein the inner wall of said valve bonnet is molded with a convex ring in a convex way, the convex ring is located in the periphery of said cylinder housing part and is provided with positioning ribs in the inner wall thereof, and correspondingly, said valve seat is provided with a connecting ring, the outer wall of which is provided with at least two positioning grooves which are radially arranged.

* * * * *